US010258137B2

(12) United States Patent
Quillmann

(10) Patent No.: US 10,258,137 B2
(45) Date of Patent: Apr. 16, 2019

(54) CLIP-ON POUCH

(71) Applicant: Tamarah Renee Quillmann, Albuquerque, NM (US)

(72) Inventor: Tamarah Renee Quillmann, Albuquerque, NM (US)

( * ) Notice: Subject to any disclaimer, the term of this patent is extended or adjusted under 35 U.S.C. 154(b) by 0 days.

(21) Appl. No.: 15/471,213

(22) Filed: Mar. 28, 2017

(65) Prior Publication Data

US 2018/0279749 A1 Oct. 4, 2018

(51) Int. Cl.

| | |
|---|---|
| ***A45F 5/00*** | (2006.01) |
| ***A45F 5/02*** | (2006.01) |
| ***A41D 27/20*** | (2006.01) |
| ***A41B 1/08*** | (2006.01) |
| ***A41B 9/00*** | (2006.01) |
| ***A41B 11/00*** | (2006.01) |
| ***A41C 1/12*** | (2006.01) |
| ***A41D 1/04*** | (2006.01) |
| ***A41D 1/06*** | (2006.01) |
| ***A41D 1/18*** | (2006.01) |
| ***A41D 1/14*** | (2006.01) |
| ***A41D 13/00*** | (2006.01) |
| ***A41D 7/00*** | (2006.01) |
| ***A43B 3/00*** | (2006.01) |
| ***A41D 20/00*** | (2006.01) |

(52) U.S. Cl.

CPC ..... *A45F 5/02* (2013.01); *A41B 1/08* (2013.01); *A41B 9/00* (2013.01); *A41B 11/006* (2013.01); *A41C 1/12* (2013.01); *A41D 1/04* (2013.01); *A41D 1/06* (2013.01); *A41D 1/14* (2013.01); *A41D 1/18* (2013.01); *A41D 7/00* (2013.01); *A41D 13/0015* (2013.01); *A41D 20/00* (2013.01); *A41D 27/20* (2013.01); *A43B 3/0031* (2013.01); *A45F 5/021* (2013.01); *A45F 2005/008* (2013.01)

(58) Field of Classification Search

CPC ..... A45F 5/021; A45F 5/02
USPC ..... 224/666–668, 655; 190/902
See application file for complete search history.

(56) References Cited

U.S. PATENT DOCUMENTS

| | | | | |
|---|---|---|---|---|
| 1,314,392 A | | 8/1919 | Glamzo | |
| 3,286,890 A | * | 11/1966 | Hildebrandt | F41A 9/60 224/241 |
| 4,201,259 A | | 5/1980 | Alsdorf | |
| 4,226,006 A | | 10/1980 | Toyama | |
| 4,414,716 A | * | 11/1983 | Stastney | A41F 1/00 24/3.12 |
| 4,416,315 A | | 11/1983 | Foley | |
| 4,444,342 A | | 4/1984 | Powell | |
| 4,626,457 A | | 12/1986 | Willie | |
| 4,705,086 A | * | 11/1987 | O'Neill | A45C 1/04 150/134 |
| 4,903,745 A | | 2/1990 | Roman | |

(Continued)

*Primary Examiner* — Adam J Waggenspack
(74) *Attorney, Agent, or Firm* — Iron Gate Intellectual Property, LLC; Andres Salazar

(57) ABSTRACT

Various embodiments of a clip-on pouch to be attached to an article of clothing providing storage and immediate access to small items such as credit cards or spare keys for a home, car, or locker. The clip-on pouch is designed to be comfortable and concealable even when worn on undergarments. One embodiment provides storage for at least one spare key. Another embodiment provides a pouch sized large enough to store at least one credit card and spare key. Various designs for the clip are presented.

2 Claims, 8 Drawing Sheets

(56) References Cited

U.S. PATENT DOCUMENTS

| | | | | |
|---|---|---|---|---|
| 4,915,215 | A | 4/1990 | Brekke | |
| 5,114,061 | A | 5/1992 | Brady | |
| 5,398,384 | A * | 3/1995 | Rinard | B42F 1/06 24/67 R |
| 6,170,087 | B1 | 1/2001 | Brannon | |
| 6,286,736 | B1 | 9/2001 | Angus et al. | |
| 6,533,414 | B2 * | 3/2003 | Newler | G02C 3/04 224/251 |
| 9,392,862 | B1 * | 7/2016 | Hajianpour | A45F 5/021 |
| 9,451,821 | B1 * | 9/2016 | Estigoy | A45F 5/021 |
| 9,551,367 | B1 * | 1/2017 | Shieh | F16B 2/20 |
| 2008/0023022 | A1 * | 1/2008 | Chudzik | A45D 8/24 132/279 |
| 2013/0105528 | A1 | 5/2013 | Enayati | |
| 2016/0120282 | A1 * | 5/2016 | Darby | A45F 5/02 24/457 |

* cited by examiner

CLIP-ON POUCH

BACKGROUND OF THE INVENTION

1. Field of the Invention

The invention relates generally to wearable storage containers for small items. The pouch is specifically designed to removably attach to an article of clothing.

2. Description of the Related Art

There are times when one accidentally closes the door to one's house or car after locking the door, leaving the needed keys inside the house, apartment, hotel, or vehicle. This causes undue stress to gain future entry into the locked house, apartment, hotel, or vehicle. The present invention allows immediate relief from such an occurrence as it is meant to store spare keys and is designed be worn on the person at all times. There are also times when one may need to secure a key to a locker or a vehicle, for instance, while engaged in activities such as sporting events, exercising, biking, running, or other activity. The present invention provides more comfortable and secure storage than a shoe, sock, or a pocket may provide. When an outfit does not contain pockets, the present invention provides a means for storing spare keys or credit cards on one's person at all times in a concealable fashion, if desired. The clip is designed to slide on to an article of clothing and does not require latches, springs, or hinges in order to securely attach removably to an article of clothing.

A discussion of the related art of which the present inventor is aware, and its differences and distinctions from the present invention, is provided below.

U.S. Pat. No. 6,170,087 (Brannon) titled "Article Storage For Hats," describes various embodiments of article storage systems for hats, including a wallet embodiment for the removable storage of articles within or on a hat or hats. However, Brannon does not provide any means for attaching the wallet to articles of clothing by means of a slide-on clip. Furthermore, the kit and attachment means are dependent upon a complimentary mating fastener component in order to attach his wallet or storage article, unlike the present invention. The present invention provides means for removably attaching the pouch to an article of clothing independent of a mating fastener.

Brannon does not provide any means for attaching the wallet to articles of clothing without dependent attachment points along the surface of the article to which the wallet is to be attached, as is provided by the present invention.

U.S. Pat. Publication No. 2013/284940 (Enayati) discloses a lightweight, wearable container device designed to attach to clothing to securely hold small personal items. Enayati does not provide any means for attaching the container device to articles of clothing without complementary attachment means along the surface of the article to which the device is to be attached. The present invention requires no such complementary attachment means.

U.S. Pat. No. 6,286,736 (Angus, et al.) describes a container detachably securable to an article of clothing by attachment means of a clamp secured to the container, wherein the clamp has several separate components requiring further assembly after initial production, while the clip attachment means of the present invention is one single body in its entirety, making manufacturing the clip of the present invention much more efficient and much less costly in that no further assembly is necessary after initial production of the clip of the present invention.

U.S. Pat. No. 4,416,315 (Foley) describes a device for carrying valuables. Foley's invention requires a zipper to be sewn onto the container, whereas the present invention provides a closure means securing items contained without further assembly of a zipper or other closure means. Items are much more easily accessible since there are no snaps or zippers to be unsnapped or unzipped in order to access items enclosed. The front flap of the present invention is wider than the envelope body of the pouch and is therefore held in place within the envelope of the pouch when the flap is tucked into the top opening of the pouch. The present invention requires no additional snaps, buttons, zippers, or other closure means in order to firmly secure the small item contents within the pouch. Thus, manufacturing the pouch of the present invention is much more efficient and much less costly than the container of Foley's patent. Additionally, the present invention offers more comfort without snaps, zippers, or other closure means that may come in contact with skin or other articles of clothing while being worn.

U.S. Pat. No. 4,903,745 (Roman) describes a wallet with a removable clip for a belt. The patent of Roman does not offer a more secure attachment means as in the present invention which comprises surface irregularities that provide more friction and therefore a more secure attachment means to the chosen article of clothing. Furthermore, the present invention attachment means comprises fewer components, requiring less assembly for increased manufacturing efficiency.

U.S. Pat. No. 1,314,392 (Glamzo) describes a carrying purse to be clipped onto articles of clothing to be worn under water. It is similar to the present invention only in that it is designed to contain small articles and to be attached to an article of clothing by the means of a clip. The present invention is not specifically designed for under water activities. However, the clip described in the patent of Glamzo contains several components including hinges and several different metal plates and moving parts, whereas the present invention contains an attachment means of a much simpler design and is easier to slip onto the article of clothing. Additionally, the container of the present invention is much thinner and lays more flatly between the article of clothing and the body of the person wearing the clip-on pouch, providing more comfort and allowing better concealment.

U.S. Pat. No. 5,114,061 (Brady) describes a pouch releasably clampable to wearing apparel. As an attachment means to wearing apparel, Brady describes U.S. Pat. No. 5,114,061 (Brady) describes a pouch releasably clampable to wearing apparel. As an attachment means to wearing apparel, Brady describes a clamp which comprises several components and requires several steps to attach the pouch to clothing, unlike the present invention. The present invention contains an attachment means of a much simpler design and is easier to slip onto wearing apparel. The clip attachment means of the present invention is one single body in its entirety, making manufacturing the clip of the present invention much more efficient and much less costly than the clamp described by Brady, in that no further assembly is necessary after initial production of the clip of the present invention.

U.S. Pat. No. 4,201,259 (Alsdorf) describes a security pouch for attachment to an article of clothing by means of a clip comprising an inner member and an outer member to engage tightly together and is best suited for thin materials, whereas the preferred embodiment of the present invention is designed to attach securely to thick clothing materials such as wool sweaters as well as thin clothing materials. Additionally, the present invention provides more ease of use with the slide-on clip attachment means, in that no additional inner and outer member compression or engagement is necessary as in the patent of Alsdorf. The design of the present invention provides the ability to slide the pouch onto an article of clothing with one hand. Furthermore, additional items for a closure means not required by the present invention in that the top flap is wider than the envelope portion of the pouch. This provides secure closure means while resting against the body of the person wearing the clip-on pouch. Less assembly is required during manufacturing which adds to increased efficiency during the production phase of the present invention.

U.S. Pat. No. 4,915,215 (Brekke) describes a carrying case for business cards and the like which is securable to a piece of material. The attachment means clip of Brekke's carrying case lacks the level of frictional engagement of the preferred embodiment of the present invention, since Brekke's clip does not contain several inner surface irregularities for a more secure attachment to a piece of material. Additionally the carrying case of Brekke's patent requires additional closure means whereas the present invention does not since the flap that folds over the top opening of the pouch is designed wider than the envelope portion in order to securely hold contents in place, provided that the top flap is tucked into the envelope portion of the pouch. Thus, the present invention lends itself to improved manufacturing efficiency since no added assembly is required for an additional closure means.

U.S. Pat. No. 4,705,086 (O'Neill) describes a wallet for joggers. The patent of O'Neill has an attachment means that is lacking inner surface irregularities, unlike the present invention. The present invention provides enhanced friction and stronger security means for keeping the container attached to clothing during vigorous exercise more fixedly. In addition, the attachment means of O'Neill's patent is not designed to adhere well to thick materials such as wool sweaters and the like, as is provided in the present invention. Moreover, the wallet of O'Neill's patent requires additional closure means whereas the present invention does not since the flap that folds over the top opening of the pouch is designed wider than the envelope portion in order to securely hold contents in place, provided that the top flap is tucked into the envelope portion of the pouch. Thus, the present invention lends itself to improved manufacturing efficiency since no added assembly is required for an additional closure means.

U.S. Pat. No. 4,626,457 (Willie) describes a "minipurse" for carrying small items. Willie's patent contains a slit opening and a detachable clip for attachment means to clothing or a pocket. The clip described in Willie's patent is lacking inner surface irregularities, unlike the clip of the present invention which provides enhanced friction and stronger security means for keeping the container attached to clothing during vigorous activities and exercise more fixedly. Moreover, since the small purse described in the patent of Willie is made of soft, deformable material and contains a slit opening, it may inadvertently come open easily during vigorous activity or exercise, causing the contents to fall out without notice. The present invention provides more adequate security means for both the clip adherence and a stronger means for keeping the container closure fastened more firmly, since the flap that folds over the top opening of the pouch is designed much wider than the envelope portion in order to securely hold contents in place, provided that the top flap is tucked into the envelope portion of the pouch.

U.S. Pat. No. 4,444,342 (Powell) describes a detachable waistband pouch which has a spring clip as an attachment means. The spring clip of Powell's patent is lacking inner surface irregularities, unlike the clip of the present invention which provides enhanced friction and stronger security means for keeping the container attached to clothing much better during vigorous activities and exercise.

U.S. Pat. No. 4,226,006 (Toyama) describes a safety clip for use with a wallet to be attached to a belt or waistband. The patent of Toyama lacks sufficient security grip without inner surface irregularities, unlike the clip and pouch of the present invention which provides enhanced friction and stronger security means for remaining attached to clothing much better during vigorous activities and exercise.

SUMMARY OF THE INVENTION

The invention comprises various embodiments of a pouch to be removably attached to an article of clothing by means of a clip, providing storage of small items such as credit cards or spare keys. One embodiment provides storage for at least one spare key. Another embodiment provides a pouch sized large enough to store at least one credit card. The clip-on pouch is designed to be comfortable and concealable even when worn on undergarments. Various designs are presented in the illustrated embodiments for the clip in the specification and drawings. There are embodiments presented in which the clip is designed with an arch that rises above the top of the pouch, which will allow for better concealment of the pouch underneath the article of clothing to which it is attached. The embodiments in which the clip contains surface irregularities provide added grip to keep the pouch more strongly secured to the article of clothing.

The principal objects of this invention include: secure storage of spare keys and credit cards or similar items on one's person even during vigorous activity, ease of use, simplified design, comfort, concealment, low production costs, high production efficiency, time savings, money savings, avoidance of stress, providing protection from harm, and even possibly saving a life by providing immediate accessibility during times of dire need.

DETAILED DESCRIPTION OF THE INVENTION

The present invention comprises various embodiments of a clip-on pouch to be removably attached to an article of clothing as a means for securing spare keys and a credit card, or similar items, on one's person while away from home or vehicle. This invention provides the means for immediate access to these items in times of need in addition to comfort, concealment, ease of use, simplified design, and other important features as further described in the following paragraphs.

Figure 1A:
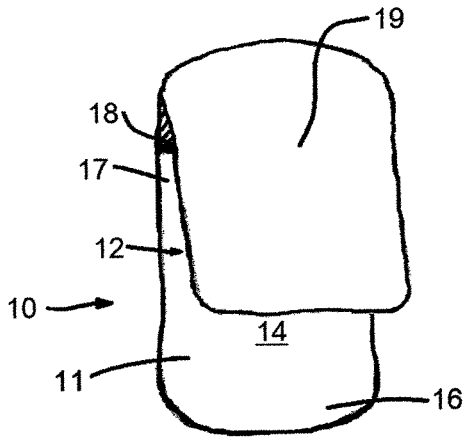
FIG. 1A is a perspective front view of the clip-on pouch.
Figure 1B:
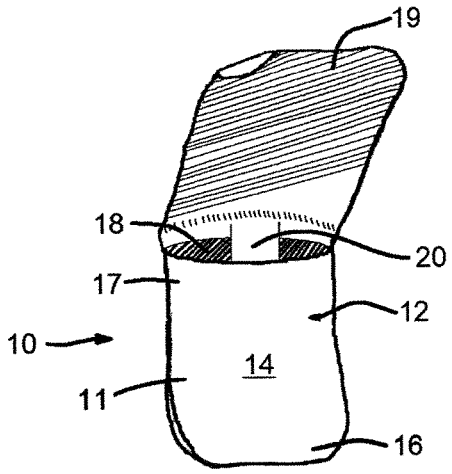
FIG. 1B is a front view of the clip-on pouch with the flap open, showing the opening and inner envelope portion of the pouch.
Figure 1C:
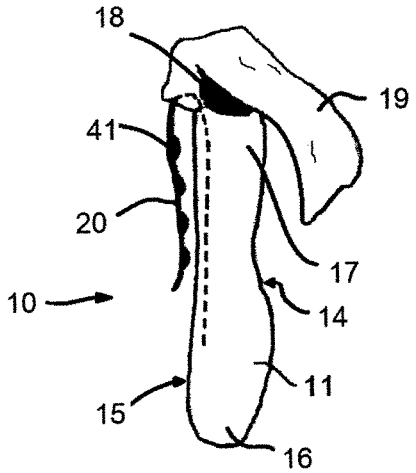
FIG. 1C is a side view of the clip-on pouch showing the clip sewn into the back portion of the pouch.

A first embodiment is illustrated in FIGS. 1A, 1B, and 1C of the drawings. In the first embodiment, the clip-on pouch 10 comprises a pouch 11, a clip 20, and a front flap 19, the pouch 11 comprising an envelope portion 12 having a front 14, a back 15, a bottom 16, and a top 17 having an opening 18, the back 15 having a flap 19 attached wherein the flap 19 folds over the opening 18 at the top 17 of the envelope portion 12. The envelope portion 12 is large enough to hold at least one spare key for a car or a house, or both. The front flap 19 is designed to be wider than the opening 18 at the top 17 of the envelope portion 12 of the pouch 11, and is therefore held in place within the envelope portion 12 of the pouch 11 when the flap 19 is tucked into the opening 18, requiring no additional snaps, buttons, zippers, or other closure means in order to firmly secure the contents within the pouch 11. Thus, efficient and less costly manufacturing is achieved. Additionally, the present invention offers more comfort and ease of use without snaps, zippers, or other closure means that may come in contact with skin or other articles of clothing while being worn. The described closure means for the pouch 11, without additional components is the preferred, best mode of the present invention. However, the present invention is not limited to the described embodiments herein. Other closure means may be used, if so desired by a consumer.

FIG. 1C shows a clip 20 sewn into the back 15 of the pouch 11 and containing a plurality of dimples 41 to provide added gripping texture. The clip 20 enables a person to removably attach the clip-on pouch 10 to an article of clothing 50, depicted in FIGS. 2A and 2B with a strap as an example of an article of clothing 50.

Figure 2A:
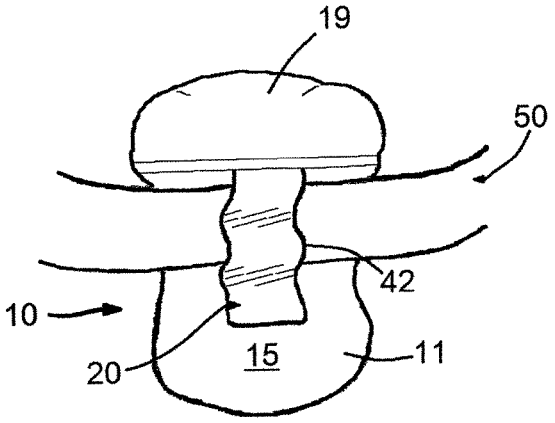
FIG. 2A is a back view of the clip-on pouch removably attached to a strap as an example of an article of clothing.
Figure 2B:
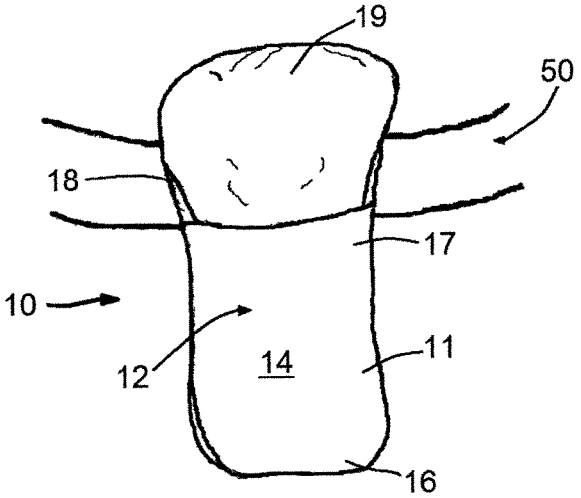
FIG. 2B is a front view of the clip-on pouch removably attached to a strap as an example of an article of clothing with the front flap tucked into the pouch.

The clip 20 of FIG. 2A illustrates an embodiment containing a plurality of curved indentations 42 forming wave-like surface irregularities to provide added gripping texture with which to secure the clip-on pouch 10 to the article of clothing 50. Multiple curved indentations 42 also allow the pouch 11 to be adjusted to the most comfortable position, for optimal comfort. FIG. 2B shows a view of the front 14 of the pouch 11 with the flap 19 tucked into the opening 18 of the top portion 17 of the envelope 12.

Figure 3A:
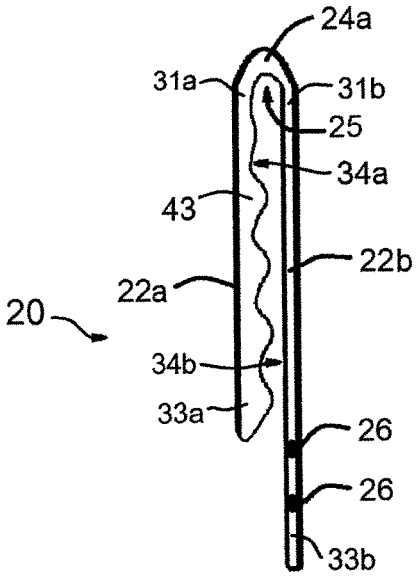
FIG. 3A is a side view of the clip with a first arm, a second arm, an upper bridge connecting the first arm to the second arm, forming an arch, the first arm having zig-zag irregularities on the inside surface of the first arm. This embodiment does not have a midsection.
Figure 3B:
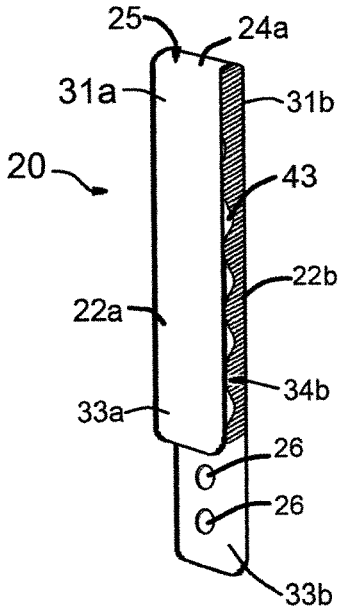
FIG. 3B is a perspective view of the clip of FIG. 3A.
Figure 3C:
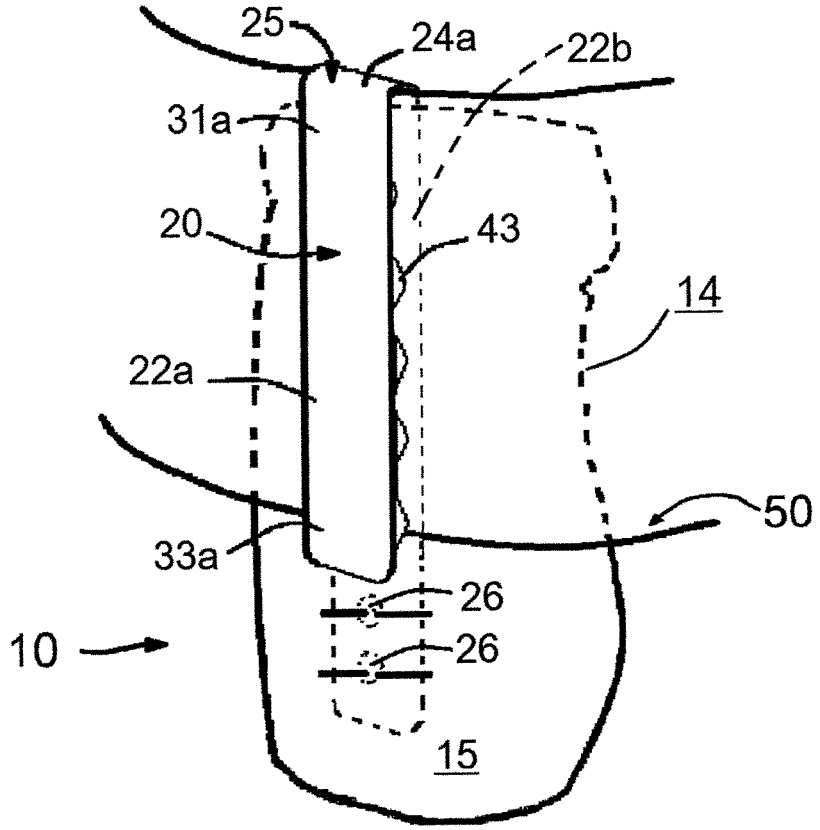
FIG. 3C is a perspective back view of the preferred embodiment of the clip-on pouch removably attached to a wide strap as an example of an article of clothing.

FIGS. 3A, 3B, and 3C illustrate an embodiment of the clip 20 which comprises a first arm 22*a* with an upper portion 31*a*, a lower portion 33*a*, and an inside surface 34*a*; a second arm 22*b* with an upper portion 31*b*, a lower portion 33*b*, and an inside surface 34*b*; and an upper bridge 24*a* connecting the upper portion of the first arm 31*a* to the upper portion of the second arm 31*b*. The upper bridge 24*a* forms an arch 25 above the upper portions of each of the first arm 22*a* and the second arm 22*b*. At least one, and preferably a plurality of attachment points 26 are drilled into the second arm 22*b* in order to more securely attach the clip 20 to the pouch 11 by stitching. The inside surface 34*a* of the first arm 22*a* has a plurality of zig-zag indentations 43 providing effective gripping means to securely adhere the clip 20 to an article of clothing 50, as depicted in FIG. 3C, with a wide strap shown as an example of an article of clothing 50.

This embodiment of the clip 20 provides ease of use by allowing a person to slide the pouch 11 on to a chosen article of clothing 50 effortlessly due to the smoothness of the zig-zag indentations 43 which also offer secure gripping means to hold the pouch 11 in place even during vigorous activity. In addition, the smoothness of the zig-zag indentations 43 allows for easy, quick removal from an article of clothing 50 without causing any damage to the article of clothing 50. The gripping means are essential to securing the clip-on pouch 10 sufficiently to a selected article of clothing 50 and must be smooth enough to ensure fabric will remain intact and free of damage of any kind, including snags and tears.

FIG. 3C illustrates the best mode of the clip-on pouch 10. However, the present invention is not limited to the described embodiments herein. As it will be seen, many other embodiments are possible within the scope of the concept of the present invention and any works falling within the scope of the claims herein should be considered in accordance with the concept of the present invention. A wide strap shown is as an example of an article of clothing 50. The attachment points 26 are shown with stitching, further securing the clip 20 to the back 15 of the pouch 11. It is to be understood that the front 14 closure of the pouch 11 with the flap 19 tucked into the opening 18 of the envelope 12 is further secured by the front 14 of the pouch 11 facing inward toward the body of the person wearing the clip-on pouch 10. The embodiment of the clip-on pouch 10 shown in FIG. 3C allows for better concealment of the pouch 11, due to the arch 25 of the clip 20 extending above the flap 19, as compared to the clip-on pouch 10 embodiment depicted in FIGS. 2A and 2B.

Figure 4A:
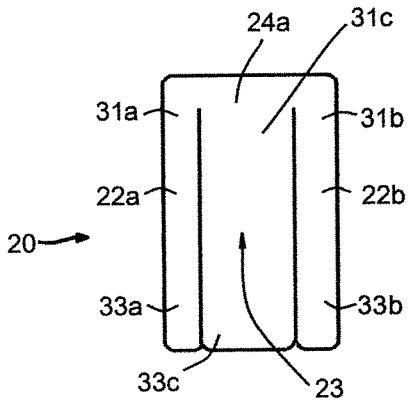
FIG. 4A is a front view of an alternative embodiment of the clip with a midsection in addition to a first arm, a second arm, and an upper bridge connecting the upper portions of each.
Figure 4B:
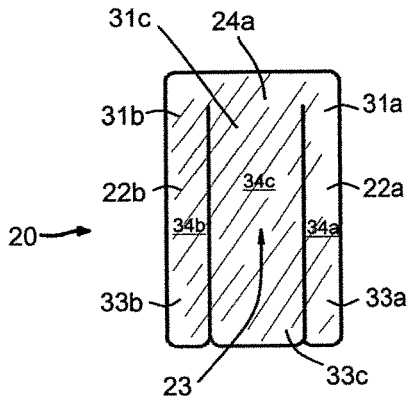
FIG. 4B is a back view of the clip of 4A, showing the inside surface of the first arm, midsection, second arm, and upper bridge connecting the upper portions of each.
Figure 4C:
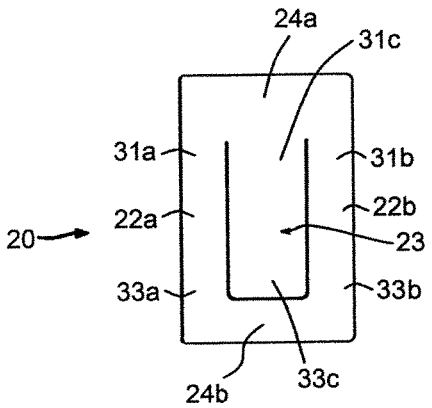
FIG. 4C is a front view of an alternative embodiment of the clip with a first arm, a midsection, a second arm, an upper bridge connecting the upper portions of the first arm, midsection, and second arm. Additionally, this embodiment comprises a lower bridge connecting the first arm to the second arm. The midsection is connected to the upper bridge only.
Figure 4D:
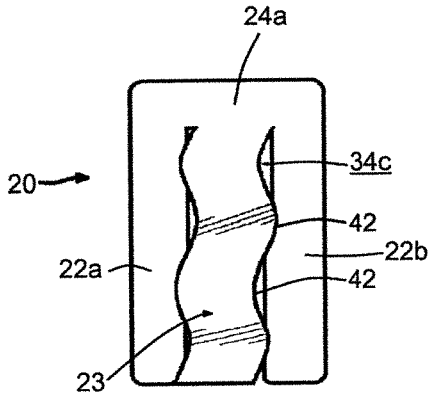
FIG. 4D is a perspective view of an alternative embodiment of the clip showing the midsection with curved surface irregularities.

The alternative clip 20 embodiments illustrated in FIGS. 4A, 4B, 4C, and 4D comprise an upper bridge 24*a*, a first arm 22*a*, a second arm 22*b*, and a midsection 23. The upper bridge 24*a* connects the upper portion 31*a* of the first arm 22*a*, the upper portion 31*c* of the midsection 23, and the upper portion 31*b* of the second arm 22*b*. The first arm 22*a* has a lower portion 33*a*, the midsection 23 has a lower portion 33*c*, and the second arm 22*b* has a lower portion 33*b*. The first arm 22*a*, the second arm 22*b*, and the upper bridge 24*a* will be sewn into the back 15 of the pouch 11, as depicted in FIG. 2B. The alternative clip 20 embodiment of FIG. 4C comprises an additional lower bridge 24*b* connecting the lower portion 33*a* of the first arm 22*a* and the lower portion 33*b* of the second arm 22*b*. This embodiment offers added support between the first arm 22*a* and the second arm 22*b*. A perspective view of a clip 10 embodiment is shown in FIG. 4D wherein the midsection 23 contains a plurality of curved indentations 42 to provide gripping texture.

The midsection 23 is offset from the first arm 22*a* and the second arm 22*b* and is used as a means for securing the pouch 11 to an article of clothing 50 by sliding the clip-on pouch 10 in a downward, sliding motion over the outward facing surface of the article of clothing 50, beginning with the lower portion 33*c* of the midsection 23. The design of the present invention provides the ability to slide the pouch 11 onto an article of clothing 50 with one hand. The clip 20 is designed to hold the pouch firmly in place even during vigorous activity. The clip 20 may be removed by pulling upward on the midsection 23. All edges of the clip 20 are smoothed to ensure no damage occurs to the article of clothing 50 during application or removal of the clip-on pouch 10 from the article of clothing 50.

Figure 5A:
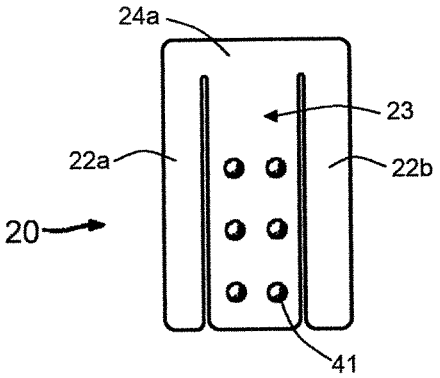
FIG. 5A is a front view of an alternative embodiment of the clip showing the midsection with a plurality of dimple surface irregularities.
Figure 5B:
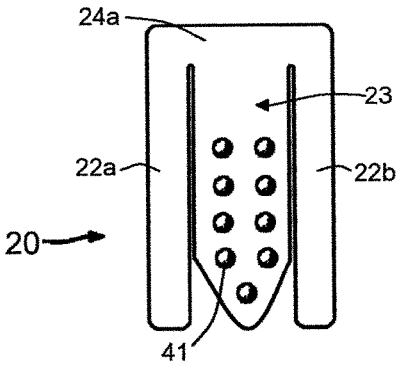
FIG. 5B is a front view of an alternative embodiment of the clip wherein the midsection is shaped like a rounded arrowhead and has a plurality of dimple surface irregularities.
Figure 5C:
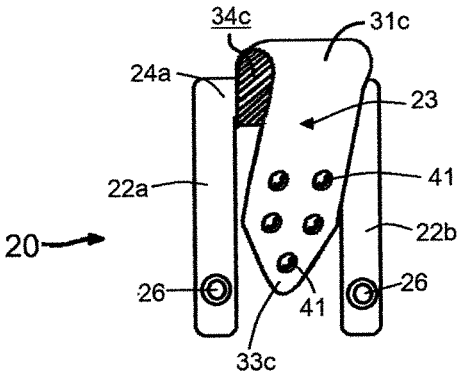
FIG. 5C is a front view of an alternative embodiment similar to the clip shown in FIG. 5B, wherein the midsection is lifted up above the upper bridge, then bowing downward at an angle, enabling the pouch to be better concealed when attached to an article of clothing. The arms in this embodiment contain attachment points for the clip to be sewn into the pouch more securely.

FIGS. 5A, 5B, 5C, as well as 1C depict a plurality of dimple indentations 41 as midsection 23 inside surface 34*c* irregularities are shown. The different types and shapes of surface irregularities described are dimple indentations 41, curved indentations 42, and zig-zag indentations 43. However, many additional different sizes and shapes of surface irregularities can accommodate different preferences desired by the consumer. The type and shape of surface irregularities are essential to providing adequate gripping friction without causing damage to clothing. The present invention is not limited to the embodiments described, and encompasses any and all embodiments within the scope of the claims herein. In addition to the dimple indentations 41, the embodiment of FIG. 5A shows the clip 20 with a first arm 22*a*, a midsection 23, a second arm 22*b*, and the upper bridge 24*a* connecting all three components together. FIG. 5B shows a similar embodiment to FIG. 5A, but the midsection 23 is shaped like a rounded arrowhead.

The alternative clip 20 embodiment featured in FIG. 5C, similar to the clip 20 of FIG. 5B with a rounded arrowhead shape to the midsection 23 and containing dimple indentations 41, can be more securely attached to thick articles of clothing such as sweaters or sweat pants with the upper portion 31*c* of the midsection 23 lifted up and bent out as the lower portion 33*c* of the midsection 23 is angled more snugly inward. This design provides added spring to the midsection 23 of the clip 20. The attachment points 26 shown in FIG. 5C on the first arm 22*a* and the second arm 22*b* allow the clip 20 to be more securely attached to the pouch 11 by stitching.

Figure 6A:
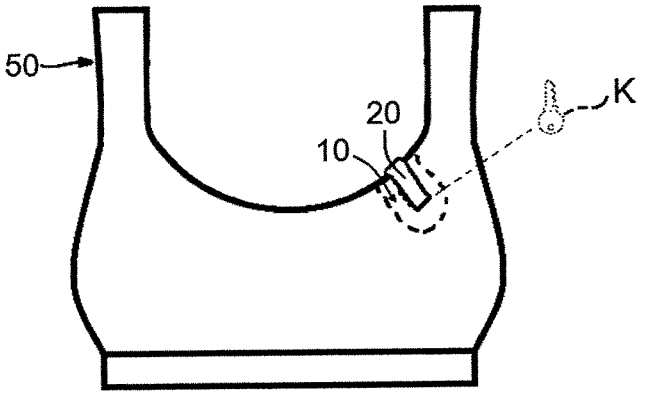
FIG. 6A is a front view of the preferred embodiment of the clip-on pouch attached to a fitness top as an example of an article of clothing, and showing an exploded view of a key as an example of a storage item contained within the pouch.
Figure 6B:
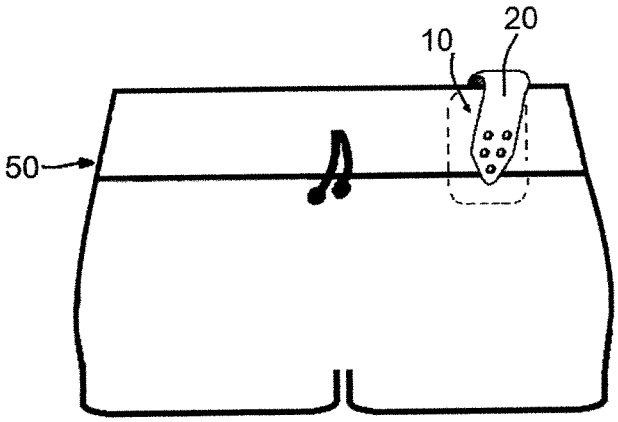
FIG. 6B shows the clip-on pouch with the clip embodiment shown in FIG. 5C attached to a pair of shorts as an example of an article of clothing.

As demonstrated herein, the midsection 23 can be shaped many different ways to provide attachment means to an article of clothing 50. FIG. 6A shows the clip-on pouch 10 attached to a fitness top as an example of an article of clothing 50, wherein the clip 20 embodiment shown is the preferred embodiment illustrated in FIGS. 3A, 3B, and 3C. A spare key K is shown as an example of an item contained inside the clip-on pouch 10. FIG. 6B shows the clip-on pouch 10 attached to the waist band of a pair of shorts as an example of an article of clothing 50, wherein the clip 20 shown is the embodiment illustrated in FIG. 5C.

Figure 7A:
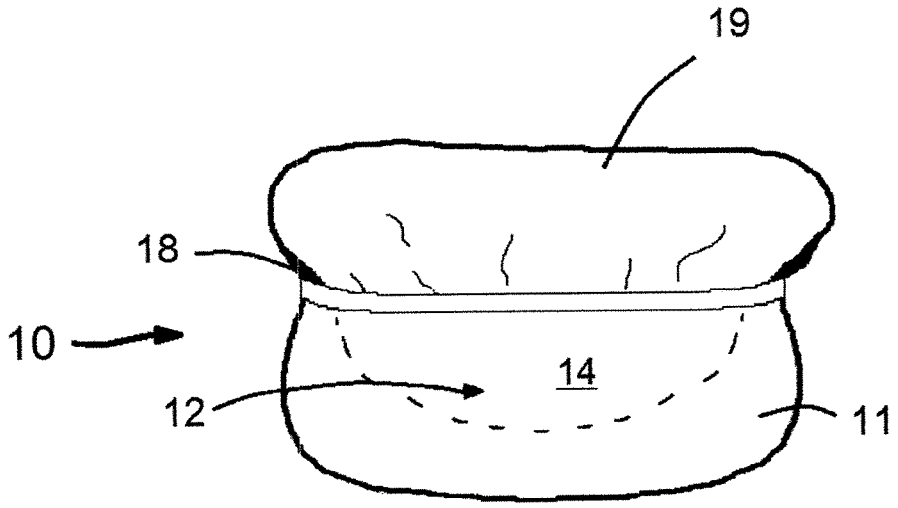
FIG. 7A is a front view of an alternative embodiment of the clip-on pouch. This embodiment is wide enough to provide the capacity to hold at least one credit card, or similar items.
Figure 7B:
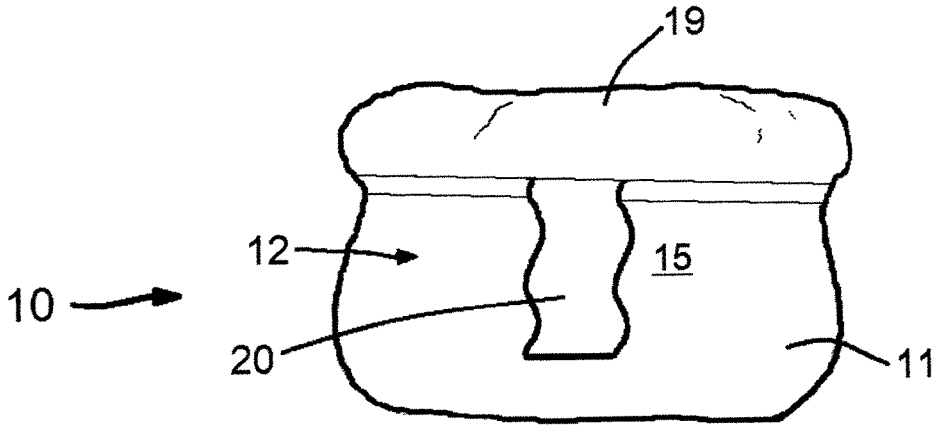
FIG. 7B is a back view of the clip of FIG. 7A, having a clip embodiment as shown in FIG. 4D containing a midsection with curved, wave-like surface irregularities.

There are times when one would like to carry a credit card or identification along with a spare key to an event without bringing a wallet or purse. Many times an outfit does not have pockets or one may want to be able to conceal the container for better security. The clip-on pouch 10 embodiment represented in FIGS. 7A and 7B is a larger version designed to hold at least one credit card, driver's license, or similar items in addition to at least one spare key. FIG. 7A is a front view of this embodiment showing the flap 19 tucked into the opening 18 of the front 14 of the envelope 12 portion of the pouch 11. FIG. 7B is a back view of the embodiment in FIG. 7A showing the clip 20 sewn into the back 15 of the pouch 11, the flap 19 sewn onto the back 15 of the envelope portion 12 of the pouch 11. The clip 20 represented is the embodiment shown in FIG. 4D.

It is preferred that the clip 20 be made of stainless steel so as not to rust even after many wash cycles. It is also extremely helpful to the environment to use stainless steel and to discontinue manufacture of any petroleum-based, non-biodegradable materials. However, for the purposes of the invention, materials used to form the clip 20 may consist of any malleable, sturdy material that will not rust.

The pouch 11 may be made of many different materials and fabrics provided the material is extremely soft while also durable. The preferred material is combed suede. Any fabric that is biodegradable and 100% natural is preferred for environmental reasons. However, many other fabrics shall be considered for the construction of the pouch 11 within the scope of the present invention. While it is not a principal object of the present invention to provide water resistance or protection from moisture to items contained, the clip-on pouch 10 may be constructed of waterproof materials in addition to other durable fabrics and materials. The pouch 11 will be available in different colors, patterns, and sizes according to consumer demand within the scope of the present invention.

It is to be understood that the present invention is not limited to the described embodiments herein. Many other embodiments are possible within the scope of the concept of the present invention, and any works falling within the scope of the claims herein should be considered in accordance with the concept of the present invention.

I claim:

1. A clip-on pouch for providing secure storage of small items comprising:

a pouch and a clip;

said pouch comprising an envelope portion for secure storage of small items and a flap;

said envelope portion having a front, a back, a bottom, and a top, the top having an opening;

said flap is wider than said envelope portion and wherein said flap is attached to the back of said envelope portion and extends over the small items stored within the envelope and secured into the front side of the top opening of said envelope portion without the use of snaps, buttons, zippers, or other closure means, thereby providing secure storage of said small items during vigorous activity;

said clip comprising a first arm with at least one attachment point, an upper portion, a lower portion, and an inside surface, a second arm with at least one attachment point, an upper portion, a lower portion, and an inside surface, and an upper bridge connecting the upper portion of the first arm to the upper portion of the second arm, the upper bridge forming an arch above the upper portions of the first arm and the second arm;

wherein the clip is attached to the back of the pouch via at least on attachment point of said clip.

2. The clip-on pouch of claim 1, wherein the inside surface of at least one of the first arm and the second arm of said clip has smooth surface irregularities comprising at lease on zig-zag indentation.

* * * * *